US009480130B2

(12) United States Patent
Van De Sluis et al.

(10) Patent No.: US 9,480,130 B2
(45) Date of Patent: Oct. 25, 2016

(54) REMOTE CONTROL OF LIGHT SOURCE

(71) Applicant: KONINKLIJKE PHILIPS N.V., Eindhoven (NL)

(72) Inventors: Bartel Marinus Van De Sluis, Eindhoven (NL); Roel Peter Geert Cuppen, Venlo (NL)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 61 days.

(21) Appl. No.: 14/375,913

(22) PCT Filed: Jan. 30, 2013

(86) PCT No.: PCT/IB2013/050782
§ 371 (c)(1),
(2) Date: Jul. 31, 2014

(87) PCT Pub. No.: WO2013/121311
PCT Pub. Date: Aug. 22, 2013

(65) Prior Publication Data

US 2015/0022123 A1 Jan. 22, 2015

Related U.S. Application Data

(60) Provisional application No. 61/597,858, filed on Feb. 13, 2012.

(51) Int. Cl.
*H05B 37/02* (2006.01)

(52) U.S. Cl.
CPC ..... *H05B 37/0245* (2013.01); *H05B 37/0272* (2013.01)

(58) Field of Classification Search
CPC ..... H05B 37/0245; H05B 37/0272
USPC ..... 315/292, 312
See application file for complete search history.

(56) References Cited

U.S. PATENT DOCUMENTS

| | | | | |
|---|---|---|---|---|
| 8,405,323 | B2 * | 3/2013 | Finney | H05B 37/029 315/130 |
| 2005/0248299 | A1 * | 11/2005 | Chemel | H05B 37/029 315/312 |
| 2010/0090617 | A1 | 4/2010 | Verberkt et al. | |
| 2011/0112691 | A1 | 5/2011 | Engelen | |
| 2011/0187290 | A1 * | 8/2011 | Krause | H05B 33/0863 315/312 |
| 2011/0273114 | A1 | 11/2011 | Ogg et al. | |
| 2014/0265882 | A1 * | 9/2014 | Laski | H05B 33/0854 315/158 |

FOREIGN PATENT DOCUMENTS

| | | | |
|---|---|---|---|
| WO | 2008001259 | A2 | 1/2008 |
| WO | 2009004531 | A1 | 1/2009 |

(Continued)

*Primary Examiner* — Don Le

(57) ABSTRACT

A lighting system comprises a set of light sources and a remote control unit. The remote control unit comprises a user interface through which a user may identify an area in an image and a light source. The identified image area is linked with the light source and color information of the identified image area is transmitted to the light source. The light source is thereby enabled to adapt its light output to the color information. A user is thereby enabled to pick the color to be outputted by a light source by selecting an area in an image displayed on the remote control unit. The remote control unit may be part of a mobile telephone, a tablet computer, an electronic photo frame, or a television screen.

15 Claims, 5 Drawing Sheets

(56) References Cited

FOREIGN PATENT DOCUMENTS

| | | | |
|---|---|---|---|
| WO | 2009004586 | A1 | 1/2009 |
| WO | 2011073881 | A1 | 6/2011 |
| WO | 2011092609 | A1 | 8/2011 |

* cited by examiner

REMOTE CONTROL OF LIGHT SOURCE

CROSS-REFERENCE TO PRIOR APPLICATIONS

This application is the U.S. National Phase application under 35 U.S.C. §371 of International Application No. PCT/IB13/050782, filed on Jan. 30, 2013, which claims the benefit of U.S. Provisional Patent Application No. 61/597,858, filed on Feb. 13, 2012. These applications are hereby incorporated by reference herein.

FIELD OF THE INVENTION

The present invention relates to the field of lighting systems and in particular to a remote control unit and a method for controlling a set of light sources in the lighting system.

BACKGROUND OF THE INVENTION

The advent of integrated lighting installations, consisting of an ever growing number of individually controllable light sources, luminaires, lighting arrangements and the like with advanced rendering capabilities, may be regarded as transforming lighting systems for both professional and consumer markets. This brings a need for an intuitive control capable of fully exploiting the rendering capabilities of the complete lighting infrastructure.

For example, it could be expected that consumers would desire to realize a more personalized environment in which they can feel relaxed, and comfortable and where they, by means of individually controllable light sources, luminaires, lighting arrangements and the like, can create their own ambiences. However, with this increasing flexibility the challenge is to keep the user interaction for atmosphere creation simple and enjoyable.

Several approaches have been proposed to control light sources, luminaires, lighting arrangements and the like.

A first example involves a wall-mounted control unit. At commissioning time a set of wall-mounted control units are installed, each of them controlling an individual or group of light sources or luminaires, possibly with optimized controls for each type of control unit.

A second example involves having a separate remote control unit for each individual light source or luminaire. This may be regarded, by means of the remote control unit, as a more or less straight forward extension of the above disclosed wall-mounted control.

International application WO 2011/092609, as a third example, relates to an interactive lighting control system with means to detect the location to which a user is pointing in the real environment, and means to create a desired light effect as this location.

SUMMARY OF THE INVENTION

The inventors of the enclosed embodiments have identified a number of disadvantages with the above noted first, second and third examples. For example, carrying along an individual remote control unit for each light can be a tedious and error prone process. For example, a hard-wired wall-mounted control unit does not scale well. In relation to the third example, one problem may be that the location of some or even all individual lighting elements may be unknown. As a result thereof it could be difficult to make a proper mapping from image to lighting elements.

It is an object of the present invention to overcome at least one of these problems, and to provide a remote control unit and a method for controlling a set of light sources that are less time consuming, more flexible and scalable, without being complex or error prone.

The inventors of the enclosed embodiments have realized that advances in connectivity may enable seamless interoperability between the lighting infrastructure and interactive devices, such as mobile telephones, tablet computers, electronic photo frames, and television screens. This could enable ways for creating lighting settings and lighting scene using the mobile telephone, tablet computer, electronic photo frame, or television screen as a remote control unit.

It is therefore a particular object of the present invention to propose an easy way for operators (end-users) to perform settings to lighting elements by indicating relations between selected areas in an image and available light sources.

According to a first aspect of the invention, this and other objects are achieved by a remote control unit for controlling a set of light sources, comprising a user interface arranged to receive user input identifying an area in an image, the area being identified by a set of coordinates, the set of coordinates associated with color information; and to receive user input identifying a light source, a processing unit arranged to link the light source with the set of coordinates; and a transmitter arranged to transmit the color information associated with the set of coordinates to the light source.

For the purpose of this disclosure the term 'color information' is defined as information related to at least one of hue, saturation, brightness, color, color temperature, RGB color space or CIE color space, intensity and frequency of emitted light. Furthermore, the actual data representation transmitted from the remote control unit to the light sources can be of any suitable kind. Typically, what is actually transmitted is not color data per se but data representative of the color information extracted from the image. However, many alternatives are possible and are encompassed by the term "color information".

Preferably this allows for control of light sources which do not have any localization means and where the user is enabled to select colors of an image as a basis for determining color values of the light sources.

Preferably this enables for an easy way for operators (end-users) to manually perform the mapping between light sources and color information by manually indicating relations between selected areas in an image picture and available light sources.

An operator (end-user) is, for example, enabled to pick a color from an image by selecting an area in the image with e.g. a pointer, such as a finger or a stylus. The remote control unit may for example determine a mean color value for this area (typically such an area is larger than one pixel). For instance, an image area can have a certain size around the (x,y) image coordinate indicated by the user input. According to the disclosed embodiments, the operator (end-user) may either first select a light source and then select an image area, or first select the image area and then select the light source. Selecting the light source can be accomplished by browsing all available light sources, or by pointing towards a desired light source, or by selecting one or multiple light sources from a list of light sources. In this context browsing could include the remote control unit instructing the light source(s) to blink as a result of user interaction with the remote control unit. The user interaction could include receiving user input from one or more buttons and/or from a graphical user interface. Selecting one or multiple light sources from a list of light sources could include receiving selection of a graphical (or textual) representation of the one or multiple light sources from a user interface.

According to a second aspect of the invention, the objective is achieved by a communications device comprising the disclosed remote control unit, wherein the communications device is one from a mobile telephone, a tablet computer, an electronic photo frame, and a television screen.

According to a third aspect of the invention, the objective is achieved by a method for controlling a set of light sources, comprising receiving, by a user interface, user input identifying an area in an image, the area being identified by a set of coordinates, the set of coordinates being associated with color information; receiving, by the user interface, user input indentifying a light source, linking, by a processing unit, the light source with the set of coordinates; and transmitting, by a transmitter, the color information associated with the set of coordinates to the light source.

According to a fourth aspect of the invention, the objective is achieved by a computer program product comprising software instructions that when downloaded to a computer is configured to perform the disclosed method.

It is noted that the invention relates to all possible combinations of features recited in the claims. Likewise, the advantages of the first aspect applies to the second aspect as well as the third aspect and the fourth aspect, and vice versa.

BRIEF DESCRIPTION OF THE DRAWINGS

The above and other aspects of the present invention will now be described in more detail, with reference to the appended drawings showing embodiment(s) of the invention.

DETAILED DESCRIPTION

The below embodiments are provided by way of example so that this disclosure will be thorough and complete, and will fully convey the scope of the invention to those skilled in the art. Like numbers refer to like elements throughout.

One problem with the prior art is, as mentioned above, that the location of individual lighting elements often is unknown. This makes it difficult to make a proper mapping from an image to lighting elements. For that reason, the proposed embodiments are related to means for user interaction, which gives operators (end-users) the possibility to make a mapping between colors in an electronic image (segment) and specific light sources. As will be further elaborated below, such means could be realized by using graphical representations (such as image icons) of available light sources being displayed on top of an image, thereby enabling the operator (end-user) to move, drag or otherwise manipulate the graphical representation towards particular positions on the image. As a result, each light source may be set to emit light of a color corresponding to the color of the image segment as selected via the graphical representations.

Figure 1:
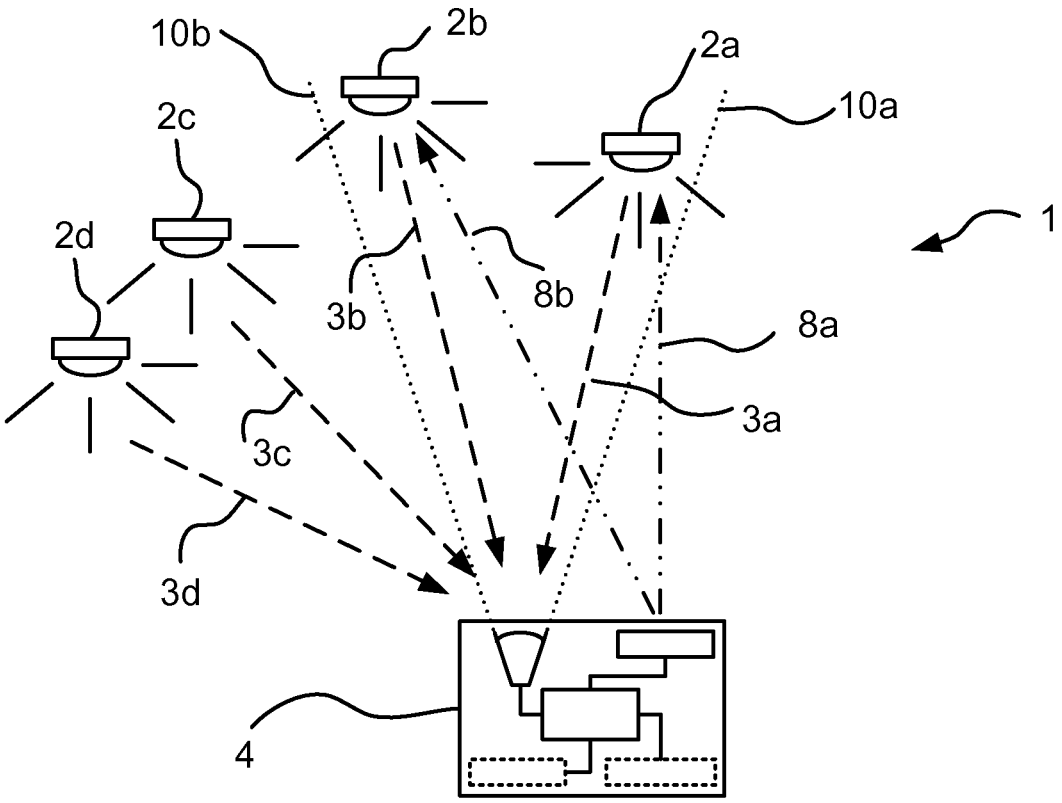
FIG. 1 illustrates a lighting system according to embodiments.
Figure 2:
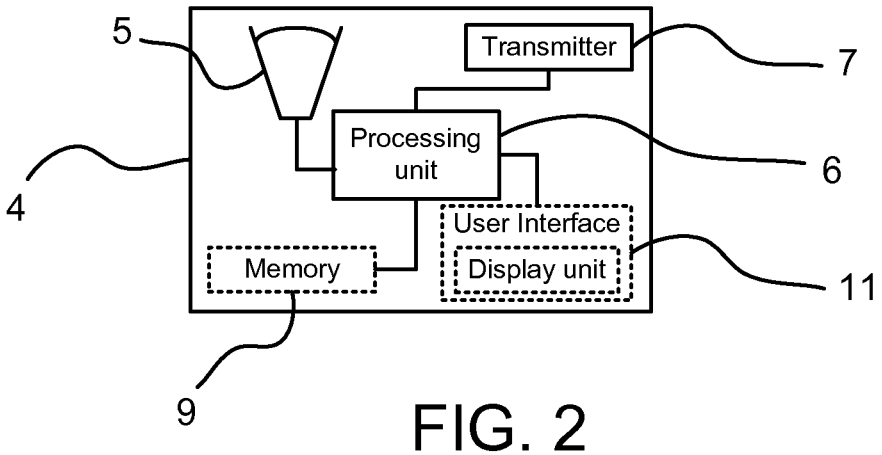
FIG. 2 illustrates a remote control unit.
Figure 3A:
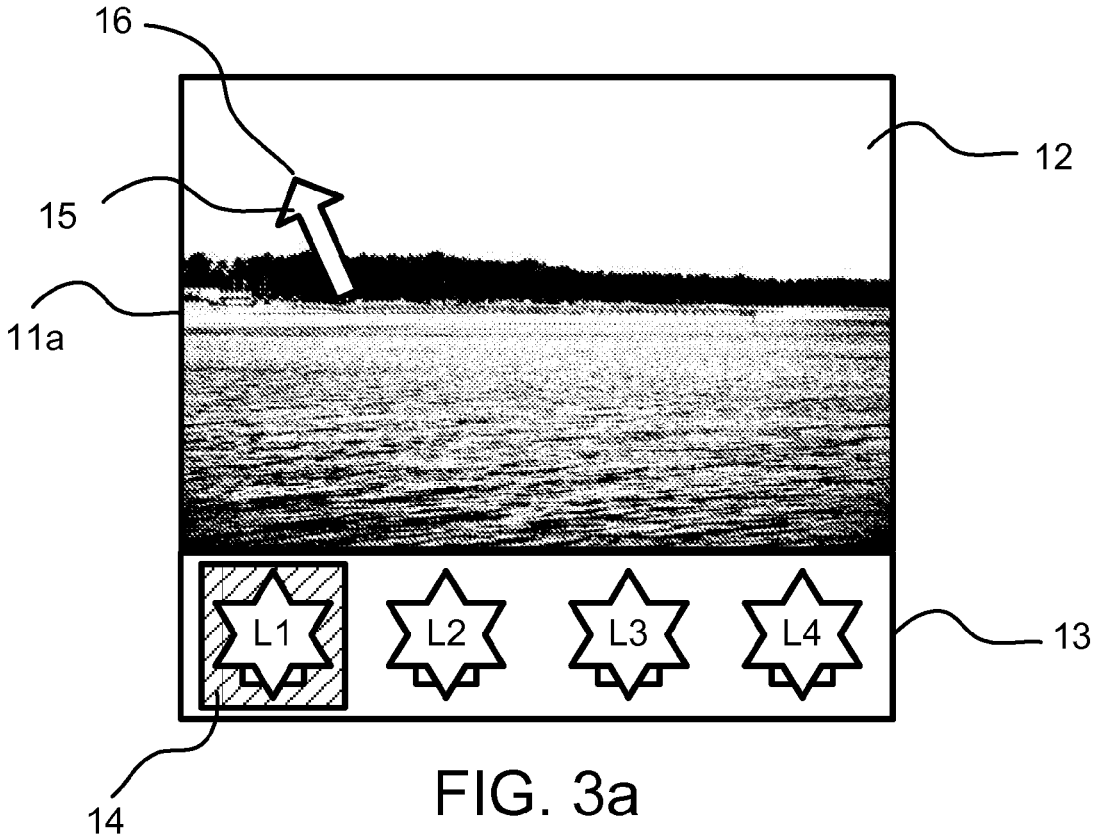
FIGS. 3*a*, 3*b*, and 6 illustrate user interfaces.
Figure 3B:
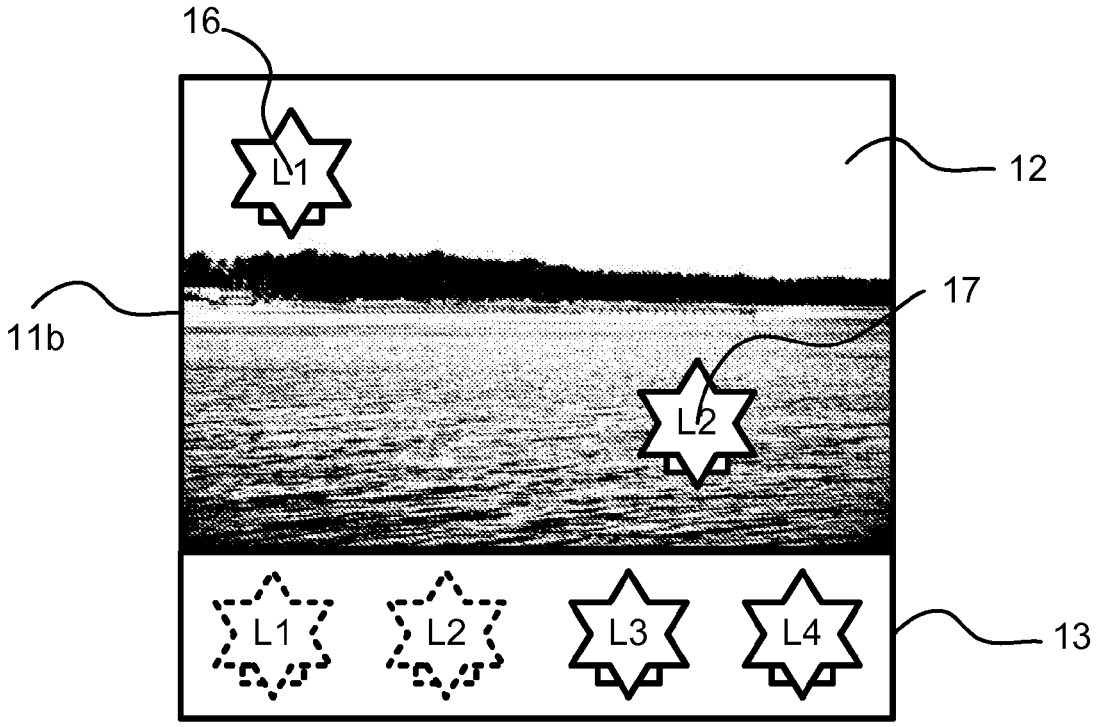
Figure 4:
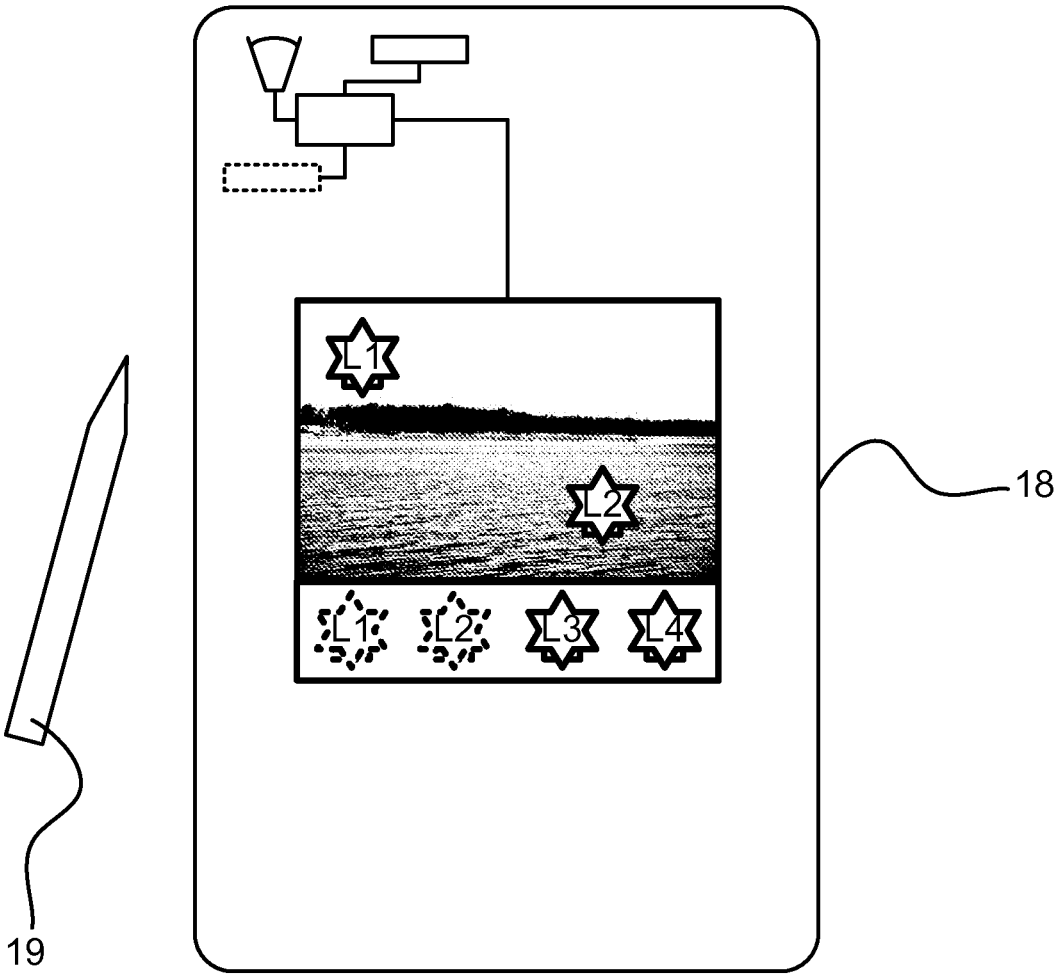
FIG. 4 illustrates a communications device.
Figure 5:
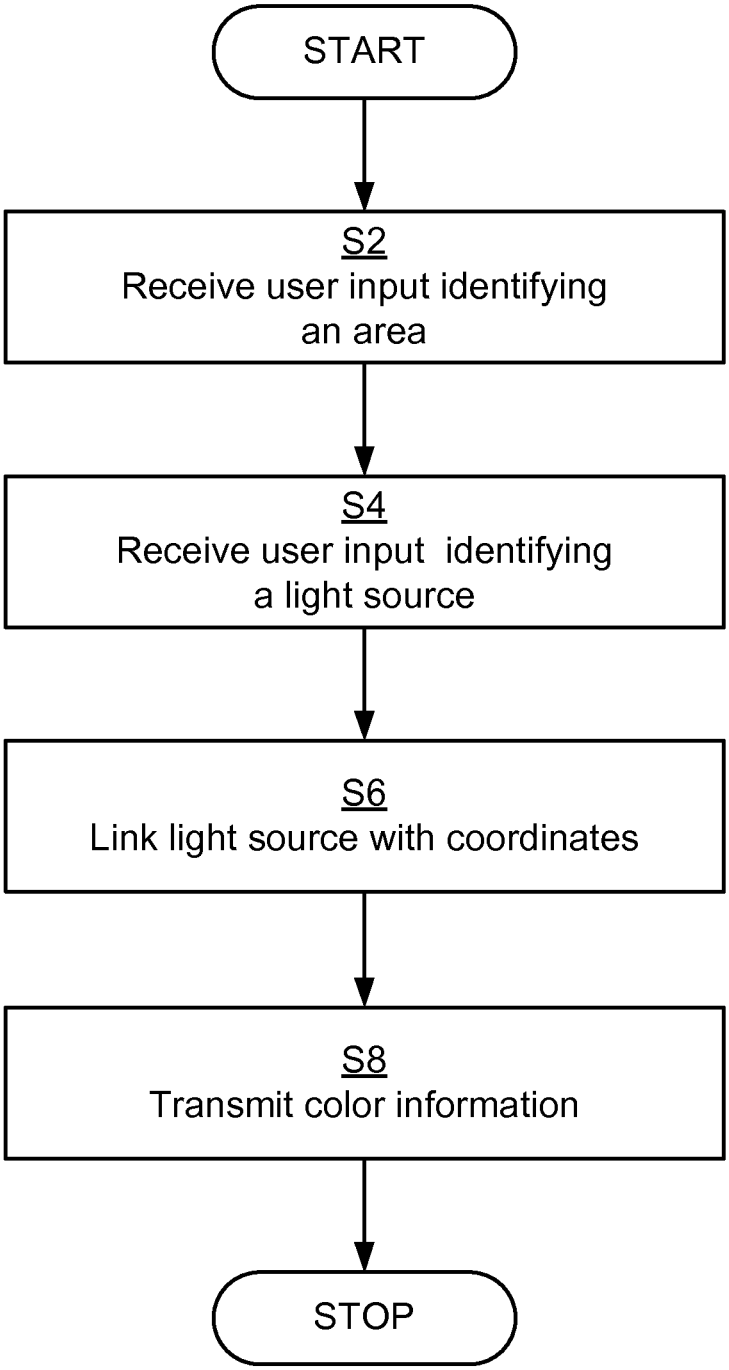
FIG. 5 is a flowchart according to embodiments.

Operation of a lighting system will now be disclosed with reference to the lighting system 1 of FIG. 1, the remote control unit 4 of FIG. 2, the user interfaces 11*a*, 11*b* of FIGS. 3*a* and 3*b*, the communications device 18 of FIG. 4, and the flowchart of FIG. 5.

The lighting system 1 of FIG. 1 comprises at least one light source, schematically denoted by light sources with reference numerals 2*a*, 2*b*, 2*c*, 2*d*. The at least one light source 2*a*, 2*b*, 2*c*, 2*d* may be a luminaire and/or be part of a lighting control system. A luminaire may comprise one or more light sources. The term "light source" means a device that is used for providing light in a room, for purpose of illuminating objects in the room. A room is in this context typically an apartment room or an office room, a gym hall, an indoor retail environment, a theatre scene, a room in a public place or a part of an outdoor environment, such as a part of a street. The emitted light thus comprises a contribution to the illumination of its environment. Each light source 2*a*, 2*b*, 2*c*, 2*d* may also be capable of emitting coded light for communication purposes, as schematically illustrated by arrows 3*a*, 3*b*, 3*c*, 3*d*. The emitted light may thus in addition to an un-modulated part for illumination purposes also comprise a modulated part for coded light communication comprising information sequences. Additionally or alternatively each light source 2*a*, 2*b*, 2*c*, 2*d* may be capable of emitting infra red light and/or have a radio-frequency transceiver for wireless transmittance and/or reception of information. Each light source 2*a*, 2*b*, 2*c*, 2*d* may be capable of being associated with a number of light (or lighting) settings, inter alia pertaining to the illumination contribution of the light source 2*a*, 2*b*, 2*c*, 2*d* such as hue, saturation, brightness, color, color temperature, RGB color space, or CIE color space, intensity and frequency of the emitted light. In general terms, the illumination contribution of the light source 2*a*, 2*b*, 2*c*, 2*d* may be defined as a time-averaged output of the light emitted by the light source 2*a*, 2*b*, 2*c*, 2*d*.

The system 1 further comprises a device termed a remote control unit 4 arranged to control the light sources 2*a*, 2*b*, 2*c*, 2*d*. FIG. 2 schematically illustrates, in terms of a number of functional blocks, the remote control unit 4. The remote control unit 4 comprises a user interface 11 through which an operator (end-user) is enabled to interact with the functionality of the remote control unit 4. The user interface 11 is arranged to receive user input. In general terms the user interface 11 is arranged to receive identification of an area in an image and identification of a light source 2*a*, 2*b*, 2*c*, 2*d*. Various user studies have shown that to end-users images are an intuitive basis for atmosphere creation, especially for the control of so-called atmosphere creation luminaires which are capable of rendering a variety of colors (e.g. by controlling the hue, saturation and intensity values of RGB LED-based luminaires). Images often present scenes and landscapes which end-users may want to re-create in their living spaces. Those images are often already available on the above-mentioned devices which the remote control unit 4 may be part of; preferably the images are stored in the memory 9. The user interface 11 is therefore arranged to receive identification of an area in an image and identification of a light source 2*a*, 2*b*, 2*c*, 2*d* from user input. Preferably the image is a photographic image. Particularly, in a step S2 the user interface 11 receives user input identifying an area in an image. The area is identified by a set of coordinates and the set of coordinates is associated with color information. The remote control unit 4 may further comprise a display unit arranged to present the image. The display unit may be part of the user interface 11. The display unit is preferably a touch sensitive display unit. The user interface 11 may thus be arranged to receive the user input via the touch sensitive display unit.

The color information for an image area can be calculated in various ways. For instance pointer-based (x,y) coordinates, possibly including a set of coordinates or a specific pixel area around the pointer-based (x,y) coordinates, for which the mean hue, mean saturation and/or mean brightness values are determined by the processing unit 6 may be taken into account. For example the processing unit 6 may determine a mean value for the hue, saturation and/or brightness of the pixels within the set or pixel area around the pointed coordinates. These values can in turn be used to control the hue, saturation and/or intensity values of a light source. The size of the pixel area and the selected color could be dependent on characteristics of the selected area (inter alia the amount of different colors in the selected area). In an image where the selected area contains a large number of different colors, the size of the pixel area is preferably smaller than when the selected area comprises similar/homogeneous colors. According to one embodiment, the values of all pixels in the selected pixel area are statically analyzed (for example by generating a pixel histogram of pixel values associated with the set of coordinates), and the values of the pixels which are most prominent, or most close to the selected point, may be used to control the values of the selected light source.

Particularly, in a step S4 the user interface 11 receives user input indentifying a light source 2*a*, 2*b*, 2*c*, 2*d*. Particularly, as will be further elaborated upon below with reference to FIG. 3*b* the area may be identified from user input, where the user input provides instructions to place a graphical representation of the light source at the set of coordinates in the image. Alternatively, also textual representation can be used (such as provided by a drop down box menu) to select the light source. Further properties of the user interface 11 will be elaborated further upon with references to FIGS. 3*a* and 3*b*.

The ordering of step S2 and S4 may depend on the operator's (or end-user's) interaction with the user interface 11. According to one embodiment the user interface 11 is arranged to first receive user input identifying the area in the image and then to receive user input identifying the light source. According to another embodiment, the user interface 11 is arranged to first receive user input identifying the light source and then to receive user input identifying the area.

The remote control unit 4 comprises a processing unit 6. The processing unit 6 may be implemented by a so-called central processing unit (CPU). The processing unit 6 is operatively coupled to the user interface 11. In general terms the processing unit 6 is arranged to associate the image area with a light source 2*a*, 2*b*, 2*c*, 2*d*. In a step S6 the light source 2*a*, 2*b*, 2*c*, 2*d* is linked with the set of coordinates of the image area by the processing unit 6.

The remote control unit 4 comprises a transmitter 7. The transmitter 7 is operatively coupled to the processing unit 6. In general, the transmitter 7 is arranged to transmit data, as schematically illustrated by arrows 8*a*, 8*b* to one or more of the light sources 2*a*, 2*b*, 2*c*, 2*d* in the system 1. Particularly, in a step S8 the transmitter 7 transmits the color information associated with the set of coordinates to the light source 2*a*, 2*b*, 2*c*, 2*d*. The set of light sources 2*a*, 2*b*, 2*c*, 2*d* is thereby controlled by the remote control unit 4. The transmitter 7 may be a light transmitter configured to emit coded light. Alternatively the transmitter 7 may be a radio transmitter configured to wirelessly transmit information. The transmitter 7 may be configured for bidirectional communications. The transmitter 7 may comprise a radio antenna. Alternatively the transmitter 7 may comprise a connector for wired communications.

The remote control unit 4 may further comprise other components, such as a memory 9 operatively coupled to the processing unit 6 and a receiver 5 also operatively coupled to the processing unit 6. The memory 9 is operated according to principles which as such are known by the skilled person. Particularly, the memory 9 may store a plurality of images and a set of lighting settings. The lighting settings may be transmitted to light sources 2*a*, 2*b*, 2*c*, 2*d* in the lighting system 1. The receiver 5 may be capable of receiving coded light as schematically illustrated by arrows 3*a*, 3*b*, 3*c*, 3*d* from the light sources 2*a*, 2*b*, 2*c*, 2*d*. The receiver 5 may alternatively or additionally also be capable of receiving infra red light. For example, the receiver 5 may include an image sensor comprising a matrix of detector elements, each generating one pixel of a coded image, for detecting the light setting emitted by the light source(s) in the system 1 by imaging coded light and/or infra red light. The receiver 5 may additionally or alternatively comprise one or more photo diodes or the like. Yet alternatively the receiver 5 may be radio-based, thereby arranged to receive radio-frequency transmissions as transmitted by the light sources 2*a*, 2*b*, 2*c*, 2*d*. By means of the receiver 5 the remote control unit 4 may be able to identify a light source 2*a*, 2*b*, 2*c*, 2*d* by decoding the received coded light.

FIGS. 3*a* and 3*b* illustrate user interfaces 11*a*, 11*b* of possible embodiments of controlling a set of light sources 2*a*, 2*b*, 2*c*, 2*d* using the disclosed remote control unit 4. The user interface 11*a*, 11*b* comprises a displayed image 12 and a user interface panel 13. In case the user interfaces 11*a*, 11*b* is provided as a touch sensitive display unit, user input may be provided by means of user interaction with the touch sensitive display. Touch sensitive displays are as such known in the art. User input may thus be received from the touch of a finger or stylus on the touch sensitive display. The user interface panel 13 holds identification information L1, L2, L3, L4 to a number of light sources 2*a*, 2*b*, 2*c*, 2*d*. The identification information L1, L2, L3, L4 may be provided as a list of names of the light sources and/or as graphical illustrations of the light sources 2*a*, 2*b*, 2*c*, 2*d*. The graphical illustration may indicate current color information of the light sources. A container 14 may be provided to indicate that a light source is selected; in FIG. 3*a* the light source corresponding to identification information L1 is selected. The graphical appearance of the identification information L1, L2, L3, L4 may also change depending on whether or not a light source has been selected or not; in FIG. 3*b* light sources corresponding to identification information L1 and L2 are selected.

According to the embodiment illustrated in FIG. 3*a* an operator (end-user) interacts with the user interface 11*a* to browse the identification information L1, L2, L3, L4, thereby indirectly also browsing the light sources 2*a*, 2*b*, 2*c*, 2*d* in the system 1. Upon selection of a particular identification information, say L1, the corresponding light source, say 2*a*, in the system 1 may provide feedback to the operator (end-user). The feedback may be provided as blinking light emitted from the selected light source. As the skilled person understands, there are other ways of providing feedback that are equally likely. By further interaction with the user interface 11*a* the operator (end-user) provides information identifying an area in the displayed image 12. The operator (end-user) may for example indicate the area by touch input, by manipulating one or more buttons on the user interface 11*a*, by operation of a joystick on the user interface 11*a* or by manually inputting a set of coordinates. The area indicated by user input is in FIG. 3*a* illustrated by an arrow 15. The area corresponds to a set of coordinates (x1, y1) as schematically illustrated at reference numeral 16. Specific color information is associated with the set of coordinates (x1, y1) and the particular light source in the system 1 corresponding to the particular identification information selected is provided with instructions to adapts its emitted light to the specified color information. In order to do so the transmitter 7 of the remote control unit 4 transmits a message comprising the specified color information to the particular light source in the system 1.

According to the embodiment illustrated in FIG. 3*b* the operator (end-user) is enabled to interact with the user interface 11*b* by means of drag-and-drop techniques. Each light source 2*a*, 2*b*, 2*c*, 2*d* is identified on the user interface 11*b* by a corresponding graphical representation L1, L2, L3, L4. The graphical representation L1, L2, L3, L4 may thus be an icon. Upon selection of a displayed image 12 the operator (end-user) interacts with the user interface 11*b* by selecting an icon, dragging the icon from the user interface panel 13 and dropping the icon at a particular position in the image 12. In the example illustrated in FIG. 3*b* the graphical representation L1 has been moved to a position corresponding to a set of coordinates (x1, y1) as schematically illustrated at reference numeral 16. Further, in the example illustrated in FIG. 3*b* the graphical representation L2 has been moved to a position corresponding to a set of coordinates (x2, y2) as schematically illustrated at reference numeral 17. The light source, say 2*a*, represented by L1 is thus instructed with color information corresponding to coordinates (x1, y1) in the image 12 and the light source, say 2*b*, represented by L2 is thus instructed with color information corresponding to coordinates (x2, y2) in the image 12. It may also be advantageous to keep the icon positions when another image is selected. In this way the user interaction mechanism may be regarded as a way of roughly indicating relative positions of luminaires on an "image map", which can be easily fine-tuned when desired by the operator (end-user) according to the embodiments of either FIG. 3*a* or 3*b*. An operator (end-user) may also be allowed to position the icons based on the positions in the space where the corresponding light sources are in. For instance, the icon L2 which is positioned in the lower right corner may represent a luminaire which stands on the floor on the right side of the living room when viewed from the couch in the living room. Positioning of a graphical representation of a light source in the image may thus reflect an actual physical position of the light source, and/or relative positions of two or more light sources. Thus, in general, operators (end-users) may, via the user interface 11*b*, be provided with a tool to position the icons in a way which reflects the corresponding light sources' positions in the room relative to the typical viewer position of the operator (end-user) or the typical position of the display in the room. A colorful background image may therefore be displayed so as to make it easier to understand for operators (end-users) which icons match with which light source by seeing the immediate changes in colors on the display as well as from the light emitted by the light sources. As an additional option the remote control unit 4 can provide an image magnifying function. When the user clicks a graphical representation L1, L2, L3, L4 that has been positioned on the image, the image area surrounding the graphical representation L1, L2, L3, L4 is magnified. Thereby the user is able to view the image area behind the graphical representation L1, L2, L3, L4 more accurately.

According to an embodiment, by dragging two or more graphical representations L1, L2, L3, L4 on top of each other, they are grouped together and a new group icon is presented on the image 12. The group icon is dragable across the image 12. All light sources 2*a*-2*d* which correspond with the grouped graphical representations L1, L2, L3, L4 will be provided with the same information about the color settings. When the group icon is tapped it extends in size and the separate graphical representations L1, L2, L3, L4 are displayed therein and one or more thereof can be extracted from the group by dragging them out of the extended group icon.

According to an embodiment, the remote control unit 4 is provided with a multi touch function, such that multiple graphical representations L1, L2, L3, L4 are dragged at the same time.

According to one embodiment, as the graphical representations L1, L2, L3, L4 or the arrow 15 of FIG. 3*a* is/are moved over the image 12 the color information of the light sources 2*a*, 2*b*, 2*c*, 2*d* in the system 1 is updated accordingly by the transmitter 7 transmitting messages comprising the specified color information to the light sources 2*a*, 2*b*, 2*c*, 2*d*. The updating may thus be performed in real-time. According to another real-time option the color information is updated when the user changes image by for instance sliding a finger horizontally over the image to the left or right to choose another image in an image library. The new image 12 is shown behind the graphical representations L1, L2, L3, L4, which remain in position during the change of images. Even if the user slides the finger across a graphical representation positioned on the image, that has no effect on the graphical representation as long as the finger operation has started with placing the finger on the image. Thus, by placing the finger on a graphical representation and then sliding the finger the graphical representation is moved instead.

Further, instead of a single static image there may be provided a sequence of images where the processing unit 6 replaces the currently displayed image with a next image. The sequence of images may be part of a video sequence. As the images change over time the color information may thereby also be dynamic over time. According to this embodiment the remote control unit 4 is preferably part of an electronic device capable of displaying video sequences or the like. Once the light sources 2*a*, 2*b*, 2*c*, 2*d* have been associated with graphical representations L1, L2, L3, L4 which are then positioned in the image, each setting of a connected light source may be based on the color (value) calculated for the associated image area (as defined by the position of the graphical representations L1, L2, L3, L4), also when other applications (such as TV watching, video-playback) are active, resulting in an ambience light type of effect created by the connected light sources 2*a*, 2*b*, 2*c*, 2*d*.

According to an embodiment, the remote control unit 4 is arranged to generate random positions in the image for the graphical representations L1, L2, L3, L4 when the user shakes it. Thereby it is possible to create random image-based ambiences in the room.

Figure 6:
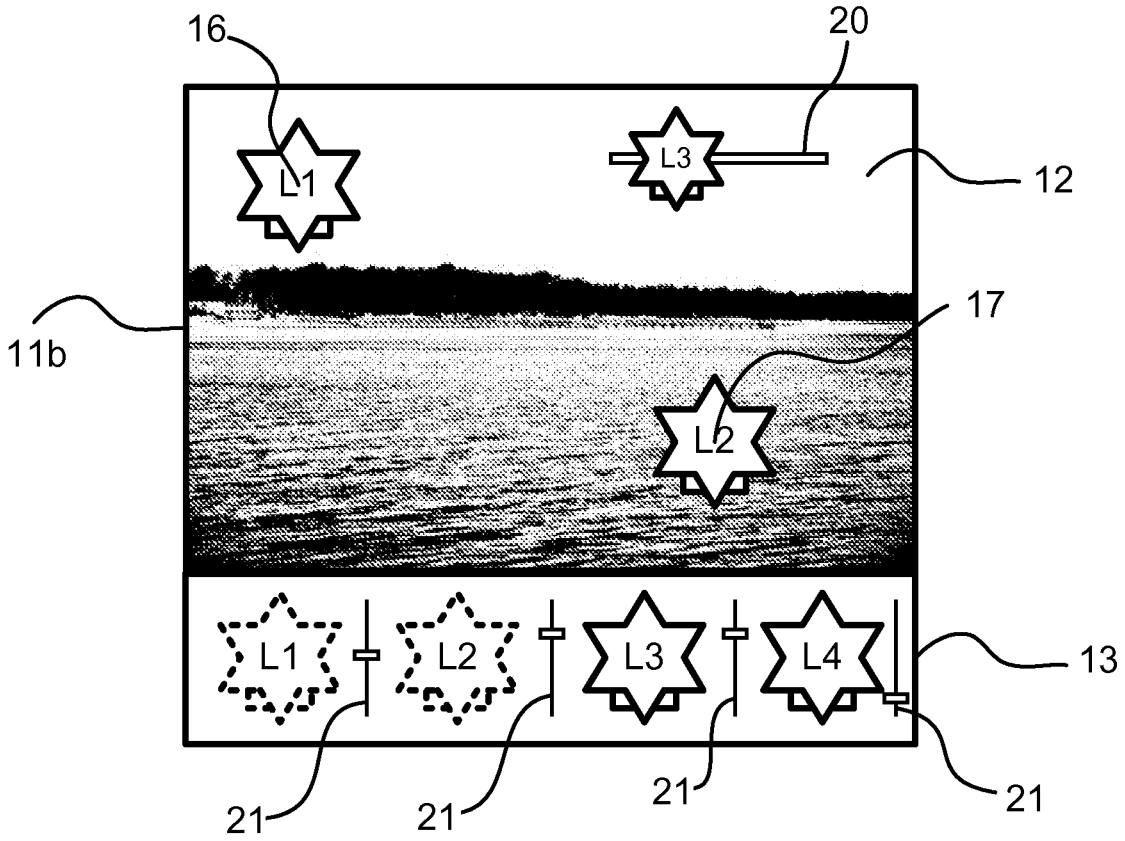

According to an embodiment, as schematically illustrated in FIG. 6, the user interface 11 comprises a color temperature bar 20 on which the graphical representations L1, L2, L3, L4 can be placed. In this embodiment the color temperature bar 20 is positioned in the image 12, close to a corner thereof. By dragging a graphical representation L1, L2, L3, L4 to the color temperature bar 20 a white color is chosen, which is then combined with the colors of the image 12 via other graphical representations. Thus, the light source(s) represented by the graphical representation on the color temperature bar 20 will emit white light of the chosen color temperature, while other light sources will emit colored light. By means of this color temperature bar 20 it is always possible to offer a user to have a light source emit white light also when no white light is available in the image 12. In one embodiment, when a graphical representation L1, L2, L3, L4 is dragged from the image 12 to the color temperature bar 20, it may (by default) be positioned on the color temperature bar 20 at a location mapping to the color of the image to a color temperature. The user may thereafter move the graphical representation across the color temperature bar 20 to select other color temperatures as desired.

According to another embodiment, though also illustrated in FIG. 6, the user interface 11, and more particularly the user interface panel 13, comprises light intensity controls 21. Each light intensity control 21 is arranged at a respective graphical representation L1, L2, L3, L4 below the image 12. The light intensity controls 21 are used for controlling the light intensity, i.e. the total intensity of the light output, of each respective light source 2*a*-2*d*. For instance each light intensity control 21 is a slider, which is operable by touch control as well. Alternatively, though less flexible, there is provided a single light intensity control 21 for all light sources 2*a*-2*d* in common.

Parts of the remote control unit 4 may be part of a communications device. FIG. 4 illustrates a communications device 18 comprising the remote control unit and a stylus 19 which may be used by an operator (end-user) to interact with the communications device 18. The communications device 18 may be a mobile telephone, a tablet computer, an electronic photo frame, or a television screen, and the herein disclosed functionality may be provided as one or more applications, so-called "Apps". The one or more applications may be stored as one or more software products stored on a (non-volatile) computer-readable storage medium such as the memory 9.

The person skilled in the art realizes that the present invention by no means is limited to the preferred embodiments described above. On the contrary, many modifications and variations are possible within the scope of the appended claims. Particularly, the disclosed remote control unit 4 and at least one luminaire comprising at least one light source 2*a*, 2*b*, 2*c*, 2*d* and being controllable by the remote control unit 4 may be provided as an arrangement. The enclosed embodiments provide interoperability between electronic communications devices such as mobile telephones, tablet computers, electronic photo frames, television screens and a connected light source infrastructure. For example, a tablet computer may function as an electronic photo frame when not being actively used, e.g. when being connected to a docking station, or a tablet holder. The tablet computer may thus provide a photo frame application, which at the same time provides control of the connected light sources 2*a*, 2*b*, 2*c*, 2*d* in such a way that the lighting scene defined by the illumination of the connected light sources 2*a*, 2*b*, 2*c*, 2*d* matches the photographic image being shown on the display of the photo frame, for example where the light sources 2*a*, 2*b*, 2*c*, 2*d* are mapped to the desired segments of the image displayed by the photo frame application.

The invention claimed is:

1. A remote control unit for controlling a set of light sources, comprising a user interface arranged to receive user input identifying an area in an image, the area being identified by a set of coordinates, the set of coordinates being associated with color information and user input identifying a light source;

a processing unit configured to determine said color information from pixel values associated with said set of coordinates and link said light source with said set of coordinates; and a transmitter arranged to transmit said color information associated with said set of coordinates to said light source.

2. The remote control unit according to claim 1, further comprising a display unit arranged to present said image.

3. The remote control unit according to claim 2, wherein said display unit is a touch sensitive display unit, and wherein said user interface is arranged to receive said user input from said touch sensitive display unit.

4. The remote control unit according to claim 1, wherein said area is identified from user input, the user input providing instructions to link a graphical representation of said light source with said set of coordinates in said image.

5. The remote control unit according to claim 4, wherein a position of a graphical representation of said light source in said image reflects a physical position of said light source.

6. The remote control unit according to claim 1, wherein said color information relates to at least one of hue, saturation, brightness, RGB color space, or CIE color space associated with said set of coordinates.

7. The remote control unit according to claim 1, wherein said processing unit is configured to determine said color information from a mean value of pixel values associated with said set of coordinates.

8. The remote control unit according to claim 1, wherein said processing unit is configured to determine said color information from a pixel histogram of pixel values associated with said set of coordinates.

9. The remote control unit according to claim 6, wherein said image is a photographic image.

10. The remote control unit according to claim 9, wherein said image is one image from a sequence of images, and wherein said processing unit is arranged to replace said image with at least one further image from said sequence of images, and wherein said transmitter is arranged to transmit color information associated with said at least one further image from said sequence of images to said light source, whereby said color information is dynamic over time.

11. The remote control unit according to claim 10, wherein said transmitter is arranged for radio based transmission.

12. The remote control unit according to claim 1, wherein said user interface is arranged to first receive user input identifying said area and then to receive user input identifying said light source, or to first receive user input identifying said light source and then to receive user input identifying said area.

13. A communications device comprising a remote control unit according to claim 1, wherein said communications device is one from a mobile telephone, a tablet computer, an electronic photo frame, and a television screen.

14. A method for controlling a set of light sources, the method comprising:

receiving, from a user interface, user input identifying an area in an image, the area being identified by a set of coordinates, the set of coordinates associated with color information;

receiving, by a receiver, user input identifying a light source, determining, by a processing unit, said color information from pixel values associated with said set of coordinates;

linking, by the processing unit, said light source with said set of coordinates; and transmitting, by a transmitter, said color information associated with said set of coordinates to said light source.

15. A non-transitory computer readable medium comprising a computer readable program for controlling a set of light sources, wherein the computer readable program when executed on a computer causes the computer to perform the steps of:

receiving, from a user interface, user input identifying an area in an image, the area being identified by a set of coordinates, the set of coordinates associated with color information;

receiving user input identifying a light source, linking said light source with said set of coordinates;

determining said color information from pixel values associated with said set of coordinates; and transmitting said color information associated with said set of coordinates to said light source.

* * * * *